United States Patent [19]

Hubbard

[11] Patent Number: 4,863,684

[45] Date of Patent: Sep. 5, 1989

[54] METHOD AND APPARATUS FOR ADDING SHOT TO MOLTEN STEEL

[75] Inventor: Mark A. Hubbard, Schererville, Ind.

[73] Assignee: Inland Steel Company, Chicago, Ill.

[21] Appl. No.: 296,666

[22] Filed: Jan. 13, 1989

[51] Int. Cl.[4] ..... C22C 33/08

[52] U.S. Cl. ..... 420/84; 75/53; 75/58; 266/216; 420/86

[58] Field of Search ..... 420/86, 84; 75/53, 58; 266/216

[56] References Cited

U.S. PATENT DOCUMENTS

| | | | |
|---|---|---|---|
| 4,389,249 | 6/1983 | Holowaty | 420/86 |
| 4,602,949 | 7/1986 | Rellis et al. | 75/130 R |
| 4,747,584 | 5/1988 | Rellis et al. | 266/287 |

*Primary Examiner*—Peter D. Rosenberg

*Attorney, Agent, or Firm*—Marshall, O'Toole, Gerstein, Murray & Bicknell

[57] ABSTRACT

A vertical first stream of molten metal flows from a ladle into the tundish of a continuous casting apparatus. A second stream composed of solid, particulate alloying ingredient and a non-oxidizing carrier gas is directed into the first stream with a nozzle. The two streams each have unenclosed parts exposed to the atmosphere surrounding the ladle and the tundish. The nozzle is cooled with a non-oxidizing gas flowing through a nozzle cooling jacket and exhausted at the outlet end of the nozzle. The nozzle interior has a converging downstream end portion for converging the second stream just before it leaves the nozzle.

41 Claims, 2 Drawing Sheets

METHOD AND APPARATUS FOR ADDING SHOT TO MOLTEN STEEL

BACKGROUND OF THE INVENTION

The present invention relates generally to methods and apparatuses for adding solid alloying ingredients to molten metal and more particularly to the addition of solid, particulate alloying ingredients to a stream of molten metal descending from an upper container to a lower container.

It is oftentimes desirable to add alloying ingredients in solid, particulate form, such as shot, to a molten metal stream descending from an upper container, such as a ladle, to a lower container, such as the tundish in a continuous casting apparatus. It is desirable to add the alloying ingredients to the descending stream of molten metal because this facilitates the mixing of the alloying ingredients into the molten metal, such as molten steel.

It is desirable also to add the alloying ingredient as shot particles, because in that form the alloying ingredient can be precisely metered, and there is rapid dissolution and dispersion of the alloying ingredient in the molten metal.

Certain alloying ingredients for molten steel, such as lead, bismuth, tellurium and selenium, typically added to molten steel to improve the machineability of the resulting solid steel product, have relatively low melting points compared to steel and are prone to excessive fuming or oxidation when added to molten steel, particularly when these alloying ingredients are in the form of shot. One expedient, for coping with the fuming and oxidation problems which arise when adding these ingredients to molten steel, comprises enclosing the descending stream of molten steel within a vertically disposed, tubular shroud having a lower end which extends below the top surface of a bath of molten steel in the tundish. The alloying ingredient is directed into the descending stream inside the shroud. The shroud protects the descending stream and the alloying ingredient against exposure to the outside atmosphere surrounding the ladle and the tundish.

When the solid alloying ingredient is introduced into the descending stream of molten steel in the form of shot, the shot can be mixed with a compressed, non-oxidizing gas, such as argon or nitrogen, which acts as a transporting or carrying medium for the shot. The mixture of shot and compressed gas is directed toward the descending stream of molten steel through a nozzle having an outlet end exposed to the interior of the shroud. When a compressed gas is employed in this manner, the compressed gas expands within the shroud and has a cooling effect therein. Furthermore, the metallic alloying ingredient undergoes a change in state as it enters the descending stream of molten steel, changing from solid shot to liquid (and some of that possibly to vapor), and this change of state absorbs heat and has an additional cooling effect within the shroud.

The addition of alloying ingredient in the form of shot, to a descending stream of molten steel, inside a surrounding shroud, employing compressed inert gas as a carrying medium, is disclosed in Rellis, et al., U.S. Pat. No. 4,602,949 ('949) entitled "Method and Apparatus for Adding Solid Alloying Ingredients to Molten Metal Stream", and the disclosure thereof is incorporated herein by reference.

A problem which can arise when employing an arrangement of the type described in the Rellis, et al. '949 patent is the build-up of a skull of steel inside the shroud. This is caused by the cooling effect of the expanding gas on droplets of molten steel which originate in the descending stream and impinge against the interior of the shroud. The cooling effect of the expanding gas causes the droplets to solidify on the interior of the shroud resulting in the build-up of the aforementioned skull. This is undesirable because skull build-up eventually can cause a blockage of the nozzle outlet end, thereby preventing the shot from entering the descending stream of molten steel.

One expedient for coping with the problem of skull build-up within the shroud is described in Peters, et al., allowed U.S. application Ser. No. 169,884 filed Mar. 18, 1988 and entitled "Method and Apparatus for Adding Liquid Alloying Ingredient to Molten Steel". In this expedient, the form of the alloying ingredient is changed from solid particulate to molten. As a result, no pressurized carrier gas is needed to convey the alloying ingredient to the interior of the shroud, and the cooling effect resulting from the expansion of the compressed carrier gas is eliminated. This expedient, however, requires auxiliary equipment to melt the alloying ingredient, to hold the alloying ingredient in molten form, and to pump or otherwise deliver the molten alloying ingredient to the shroud interior. The disclosure of said allowed Peters, et al. application is incorporated herein by reference.

When the alloying ingredient is added in the form of shot mixed with a carrier gas, the nozzle which directs the shot particles has a downstream outlet end which is exposed to the shroud interior. The shroud is composed of refractory material, and the temperature within the shroud interior is relatively high despite the cooling effect of the expanding carrier gas. The high temperature causes the nozzle to heat up, and there is a decreasing temperature gradient extending upstream in the nozzle from the nozzle outlet end. This can cause premature melting, within the nozzle, of the shot which has a relatively low melting point. The temperature gradient in the nozzle can also cause the shot, at locations upstream of the nozzle outlet end, to become sticky or tacky. As a consequence, there can be a build-up of alloying ingredient within the nozzle, at a location upstream of the nozzle outlet, eventually causing a blockage within the nozzle.

To cope with the problem described in the preceding paragraph, a special nozzle construction was developed, and this is described in Rellis, et al., U.S. Pat. No. 4,747,584 ('584) entitled "Apparatus for Injecting Alloying Ingredient Into Molten Metal Stream", and the disclosure thereof is incorporated herein by reference. The nozzle described in Rellis, et al. '584 is composed of inner and outer tubular members. The mixture of transport gas and metal shot is conducted through the inner tubular member. A cooling fluid is circulated through the outer tubular member to cool the inner tubular member. Baffles and a passageway are provided between the two tubular members to define a path along which the cooling fluid flows from an inlet location adjacent the upstream end of the nozzle downwardly towards the downstream end of the nozzle and then back upwardly toward the upstream end of the nozzle where the cooling fluid is withdrawn from the nozzle.

In the arrangements employed in the two Rellis, et al. patents, the descending stream of molten steel was introduced into the shroud through a vertically disposed conduit having a lower outlet end located near the upper end of the shroud. The lower end of the shroud was desirably disposed below the top surface of the bath of molten steel in the tundish. Problems arose which restricted the extent to which the shroud's lower end could be submerged within the bath of molten steel, and as a result, the lower outlet end of the vertically disposed conduit was located relatively far above the top surface of the bath. This was undesirable because it increased the length of the unenclosed part of the descending stream, i.e., the part between the lower outlet end of the vertically disposed conduit and the top surface of the bath. The alloying ingredient is directed into the unenclosed part of the descending stream. It is desirable to maintain the unenclosed part of the descending stream as short as possible because the longer it is, the greater the danger of oxidation.

Attempts have been made to avoid the problem of skull build-up within the shroud by eliminating the shroud. Elimination of the shroud also enables the lower outlet end of the vertically disposed conduit, to be located closer to the top surface of the bath, thereby reducing the length of the unenclosed part of the descending stream. In these attempts, the alloying ingredient was added to the descending stream of molten metal with a nozzle directed toward the stream at an angle having a downward component. This nozzle has an upstream inlet end communicating with the downstream portion of a transporting conduit. The conduit's downstream portion extends upstream at the same angle as the nozzle and communicates with an upstream portion extending horizontally directly from the downstream portion at an angle thereto. When the nozzle was uncooled or insufficiently cooled, problems arose. These problems included overheating of the nozzle and of the transporting conduit and restrictions in the flow of material through the transporting conduit. Overheating of the nozzle or of the transporting conduit also caused the shot to burn up in the conduit or nozzle or to melt therein and cause blockages.

SUMMARY OF THE INVENTION

A method and apparatus in accordance with the present invention eliminates the problems described above. In accordance with the present invention, the shroud and all the problems associated therewith are eliminated, but the use of solid particles of alloying ingredient (e.g., shot) is retained while avoiding the fuming, oxidizing and other problems associated with the use of alloying ingredients in solid, particulate form without a shroud.

In accordance with the present invention, molten metal descends in a vertical first stream from the upper container to the lower container in which is formed a bath of molten metal having a top surface. The first stream is directed into the lower container through a vertically disposed conduit having a lower end located above the top surface of the bath. That part of the first stream located below the lower end of the conduit and above the top surface of the bath is exposed to the outside atmosphere surrounding the upper and lower containers, there being no shroud surrounding the vertically disposed conduit or the descending first stream of molten metal.

A second stream comprising a mixture of solid particles of alloying ingredient and a carrier gas is directed through a nozzle having an outlet end, into the exposed part of the first stream. The nozzle and the solid particles therein are cooled by a cooling jacket through which a non-oxidizing gas (e.g., argon or nitrogen) moves in a direction parallel to the direction of movement of the second stream through the nozzle. The cooling gas is exhausted into the outside atmosphere at a location adjacent the outlet end of the nozzle.

By cooling the solid particles in the manner described, melting or burn up of the particles is minimized or eliminated. The cooling gas is exhausted adjacent the outlet end of the nozzle without changing the direction of flow of the cooling gas from (a) an upstream nozzle-cooling location to (b) the exhaust location. This enables one to maintain a relatively high velocity for the cooling gas between the two locations (a) and (b), and this enables one to maximize the cooling effect of the cooling gas on the nozzle and the solid particles therein.

The second stream, containing the solid particles, normally undergoes divergence (i.e., it spreads out) upon exiting from the outlet end of the nozzle. The nozzle is disposed to aim the second stream towards a confluence with the first stream. However, if the divergence is too great, the solid particles located at the extremities of the divergence will miss the first stream and not be incorporated into the molten metal in a desirable manner, or may be oxidized or otherwise lost.

To avoid the problem of excessive divergence, a method and apparatus in accordance with the present invention subjects the second stream to a converging step just before it leaves the outlet end of the nozzle. This converging step, together with positioning the outlet end of the nozzle sufficiently close to the first stream, produces a second stream having a width no greater than the width of the first stream at the confluence of the two streams. As a result, all of the solid particles in the second stream, even those at the extremity of the divergence, are directed into the first stream. Absent the converging step, the nozzle outlet end would have to be closer to the first stream to avoid excessive divergence, and the closer the nozzle is to the first stream, the greater the danger of overheating with all its accompanying problems.

By eliminating the shroud, the lower outlet end of the vertically disposed conduit, which directs the first stream toward the bah of molten metal in the lower container, can be positioned closer to the top of the bath, and this minimizes the exposed part of the first stream.

Because the shroud is eliminated, the cooling gas and the compressed carrier gas employed to transport the solid particles in the second stream, can be allowed to expand adjacent the confluence of the two streams, and there is no danger of producing a skull build-up which could grow and block the outlet end of the nozzle.

The cooling gas is exhausted adjacent the outlet end of the nozzle in such a manner that the cooling gas at least partially envelopes the solid particles from the second stream, at an enveloping location adjacent the outlet end of the nozzle. Because the cooling gas is non-oxidizing, it provides, at least initially, some protection, against oxidation, for the solid particles in the second stream.

Other features and advantages are inherent in the method and apparatus claimed and disclosed or will become apparent to those skilled in the art from the following detailed description in conjunction with the accompanying diagrammatic drawings.

DETAILED DESCRIPTION

Figure 1:
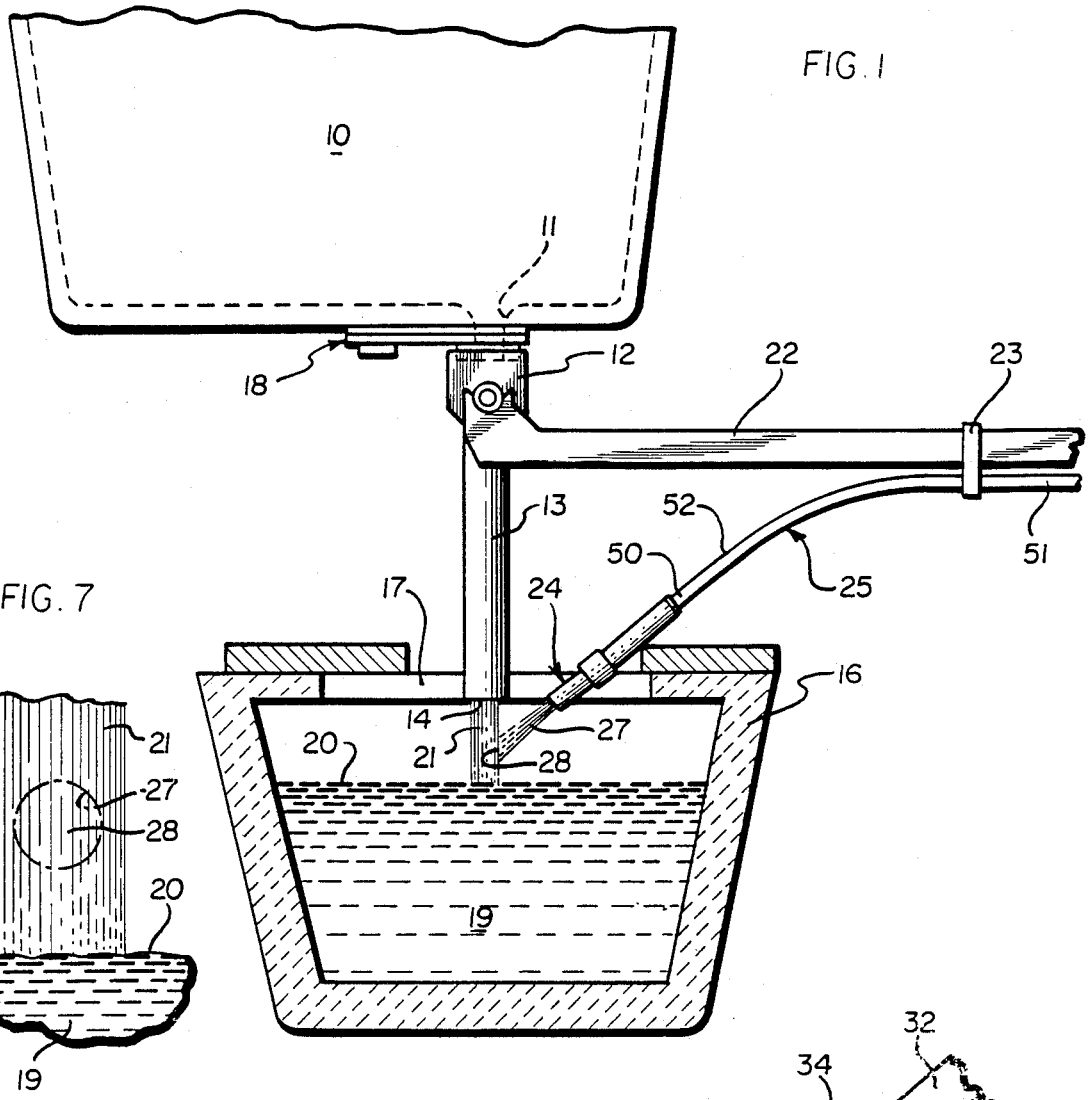
FIG. 1 is a fragmentary, side elevational view, partially in section, illustrating an embodiment of apparatus for performing a method in accordance with the present invention.

Referring initially to FIG. 1, there is shown an upper container or ladle 10 having a ladle outlet 11 communicating with the upper end portion 12 of a vertically disposed conduit 13 having a lower, outlet end 14 extending through an upper opening 17 of a lower container or tundish 16 disposed below ladle 10.

Ladle 10 holds molten metal, such as molten steel, and a movable closure gate 18 of conventional construction normally closes ladle outlet 11. Movable closure gate 18 can be actuated to an open position (shown in FIG. 1), as a result of which molten metal flows downwardly through ladle outlet 11 to form a descending first stream of molten metal which is directed by vertical conduit 13 into lower container 16 wherein there is formed a bath 19 of molten metal having a top surface 20.

In accordance with the present invention, there is no shroud enclosing lower outlet end 14 of conduit 13 or the space below lower end 14 and above top surface 20 of bath 19. As a result, that space and lower end 14 are exposed to the outside atmosphere surrounding ladle 10 and tundish 16. Conduit 13 comprises structure for directing the first stream of molten metal through the exposed space, and the exposed part of the descending first stream of molten metal is indicated at 21 in FIGS. 1 and 2.

Extending through top opening 17 of tundish 16, at an angle having a downward component, is a nozzle 24 connected to a transporting or conveying conduit 25 for introducing into the nozzle a second stream comprising a mixture of solid particles and a carrier gas. The unenclosed part of the second stream, outside of nozzle 24, is indicated at 27. Nozzle 24 directs second stream 27 into exposed part 21 of the first stream at a confluence 28 of the two streams.

Nozzle 24 has a cooling jacket 31 (FIG. 2) comprising structure for cooling the nozzle and the solid particles therein with a cooling gas moving in a direction parallel to the direction of movement of the second stream through the nozzle. The cooling gas is exhausted from jacket 31 into the outside atmosphere adjacent the nozzle.

Vertical conduit 13 is supported and positioned by a positioning mechanism 22 from which conduit 25 is suspended by a collar 23. Positioning mechanism 2, and ladle gate 18, are described in more detail in Rellis, et al., U.S. Pat. No. 4,747,584, the disclosure of which has been incorporated herein by reference.

Ladle 10 is typically supported by a conventional turret structure (not shown) which permits ladle 10 to be raised or lowered relative to tundish 16. Positioning mechanism 22 permits the lower outlet end 14 of conduit 13 to be raised or lowered relative to top surface 20 of bath 19 in conjunction with a raising or lowering of ladle 10. Because there is no shroud surrounding the space between conduit outlet end 14 and bath top surface 20, there are no external constraints on how close conduit outlet end 14 may be to bath top surface 20, as there would be if a surrounding shroud had been employed. Accordingly, conduit outlet end 14 may be located below the top opening 17 of tundish 16, subject to other constraints described below.

Nozzle 24 will now be described in greater detail, with reference to FIGS. 2-6.

Nozzle 24 comprises an inner tubular member 30 and a cooling jacket 31 surrounding the inner tubular member. Cooling jacket 31 is in the form of an outer tubular member having an upstream portion 32 and a downstream portion 33 detachably connected to upstream portion 32 by a coupling 34.

Figure 2:
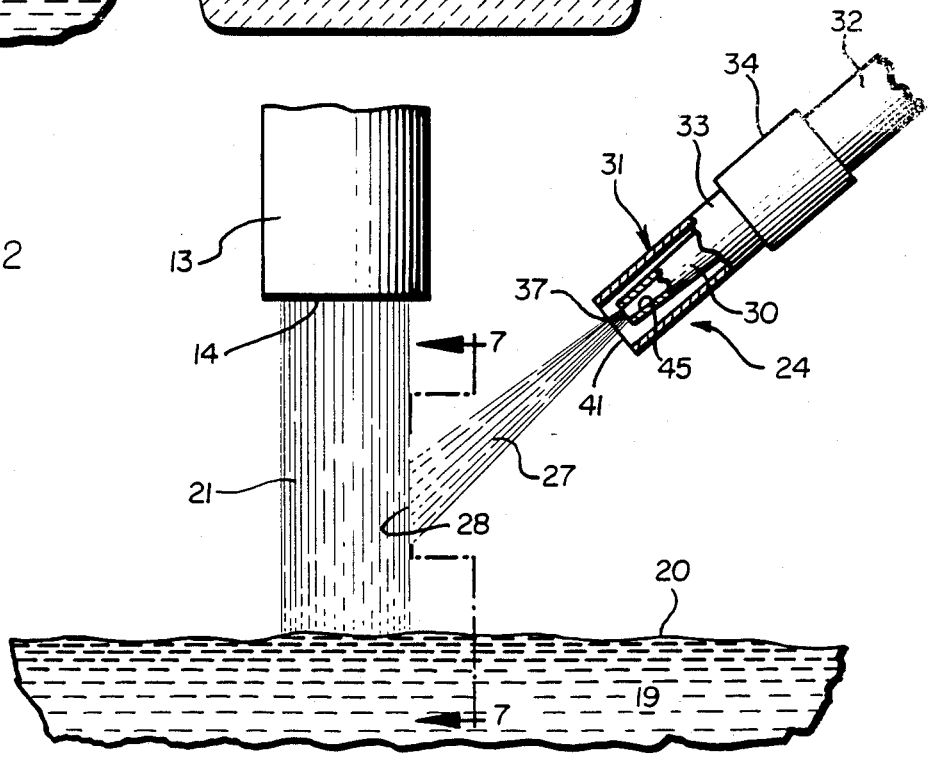
FIG. 2 is an enlarged, fragmentary view, partially in section, of a portion of the apparatus illustrated in FIG. 1.
Figure 4:
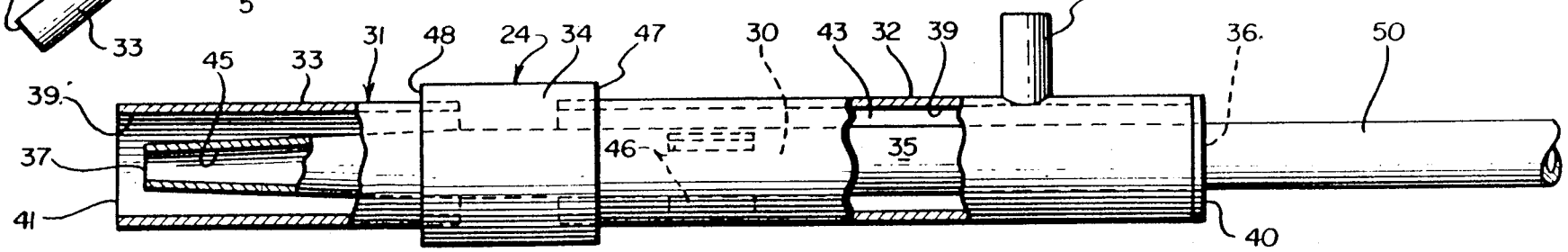
FIG. 4 is an enlarged view of the nozzle of FIG. 3.

Inner tubular member 30 has an outer surface 35, an open, upstream inlet end indicated at 36 and an open, downstream, outlet end 37. The outer tubular member has an inner surface 39 on each portion 32,33 thereof, a closed, sealed upstream end 40 on upstream portion 32 and an open, downstream, outlet end 41 on downstream portion 33 adjacent outlet end 37 of the inner tubular member. Referring to FIGS. 2 and 4, inner tubular member 30 has an internal passageway which converges at 45 toward its outlet end 37 which terminates slightly upstream of outlet end 41 on the outer tubular member.

Figure 5:
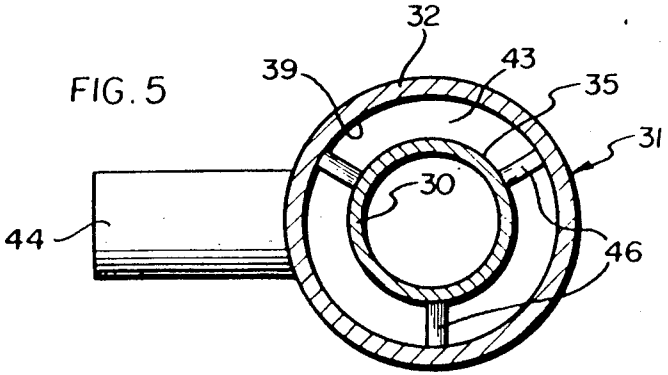
FIG. 5 is an enlarged, sectional view taken along line 5—5 in FIG. 3.
Figure 3:
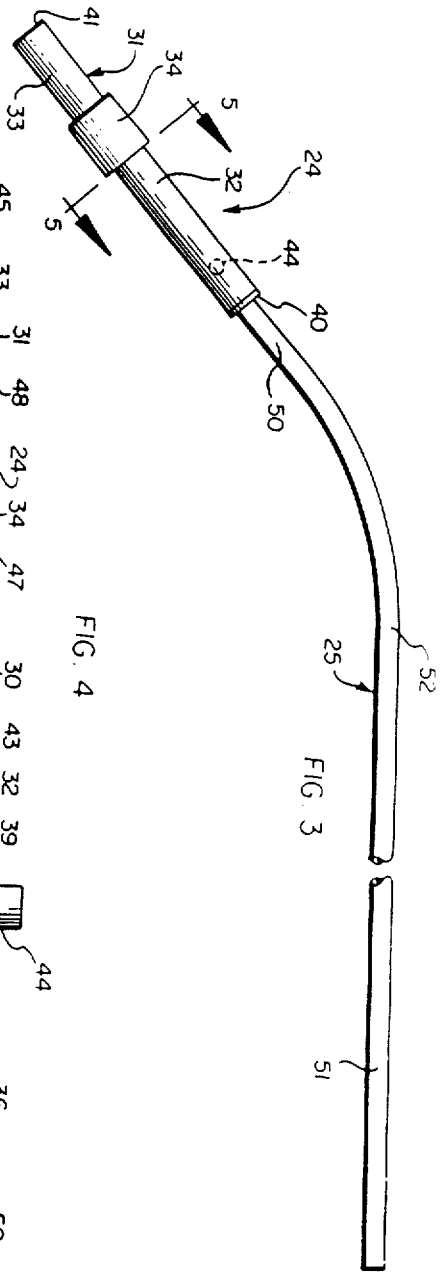
Figure 4:
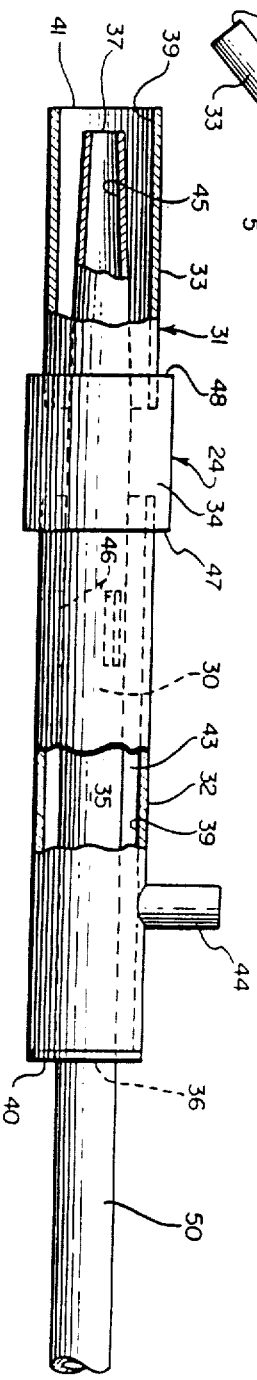
Figure 5:
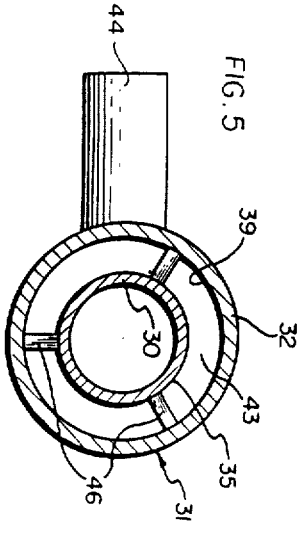
Figure 6:
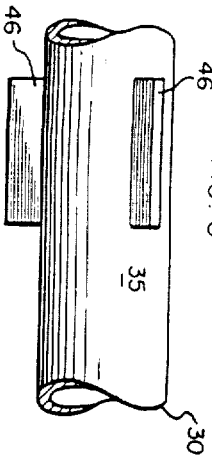

As shown in FIGS. 4 and 5, there is an annular passageway 43 between (a) outer surface 35 of inner tubular member 30 and (b) inner surface 39 of the outer tubular member. Communicating with passageway 43 is an inlet connection 44 on upstream portion 32 of the outer tubular member, adjacent the closed upstream end 40 of the outer tubular member and upstream of the outer tubular member's outlet end 41. A gaseous cooling fluid, composed of a nonoxidizing or inert gas such as nitrogen or argon, is introduced through inlet 44 into annular passageway 43 and flows downstream through the passageway, exiting at outlet end 41. The cooling gas is conducted to inlet 44 through a conduit (not shown) from a storage container (not shown).

Figure 6:
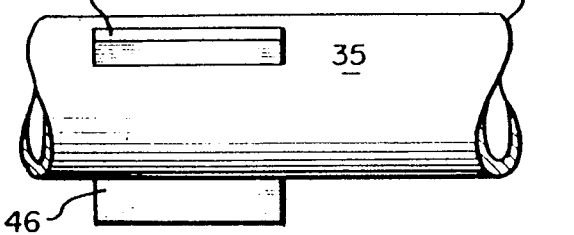
FIG. 6 is an enlarged fragmentary view of a portion of the nozzle illustrated in FIGS. 3-5.

The outer tubular member's upstream and downstream portions 32, 33, respectively, are separate and discrete from each other. Upstream portion 32 is directly mounted on the inner tubular member 30 by spacers 46 extending between the inner tubular member's outer surface 35 and the outer tubular member's inner surface 39 (FIGS. 5 and 6). As shown in FIG. 5, there are three spacers 46 each separated from the other by an angle of 120°. Spacers 46 are fixed to outer surface 35 of inner tubular member 30, and there is a friction fit between inner surface 39 of the outer tubular member's upstream portion 32 and spacers 46 which snugly engage inner surface 39.

As noted above, the outer tubular member's downstream portion 33 is detachably connected to upstream portion 32 by coupling 34 which has an upstream end 47 threadedly connected to the outer tubular member's upstream portion 32 and a downstream end 48 threadedly connected to the outer tubular member's downstream portion 33. Threaded coupling 34 is the only connection between the outer tubular member's downstream portion 33 and any other part of nozzle 24. There is no direct mounting of downstream portion 31 on inner tubular member 30. Downstream portion 33 is readily removable and separable from the rest of nozzle 24 when the downstream portion is detached from upstream portion 32 at coupling 34.

Outlet end 37 on inner tubular member 30 is relatively inaccessible when downstream portion 33 of the outer tubular member is connected to the upstream portion 32 thereof. However, when downstream portion 33 is detached from upstream portion 32, outlet end 37 on inner tubular member 30 is readily accessible.

If annular passageway 43 were partially obstructed, in downstream portion 33 of the outer tubular member, this would reduce the cooling effect available from the flow of gas through passageway 43, compared to the cooling effect obtained when the flow of gas is unobstructed in passageway 43.

From time to time, during normal operation, droplets of molten metal may solidify within the outer tubular member's downstream portion 33 or within converging portion 45 of inner tubular member 30. It is therefore necessary to periodically clean these elements. Cleaning is facilitated by the manner in which the nozzle elements are joined together. As noted above, downstream portion 33 of the outer tubular member may be readily detached from threaded end 48 of coupling 34 and separated from the rest of the nozzle to facilitate cleaning of downstream portion 33. In addition, when downstream portion 33 has been separated from the nozzle, the interior of converging portion 45 on inner tubular member 30 is readily accessible for cleaning.

The outer tubular member's upstream portion 32 does not have to be subjected to a cleaning or other maintenance operation as frequently as does downstream portion 33. Accordingly, upstream portion 32 need not be readily removable like downstream portion 33.

Figure 3:
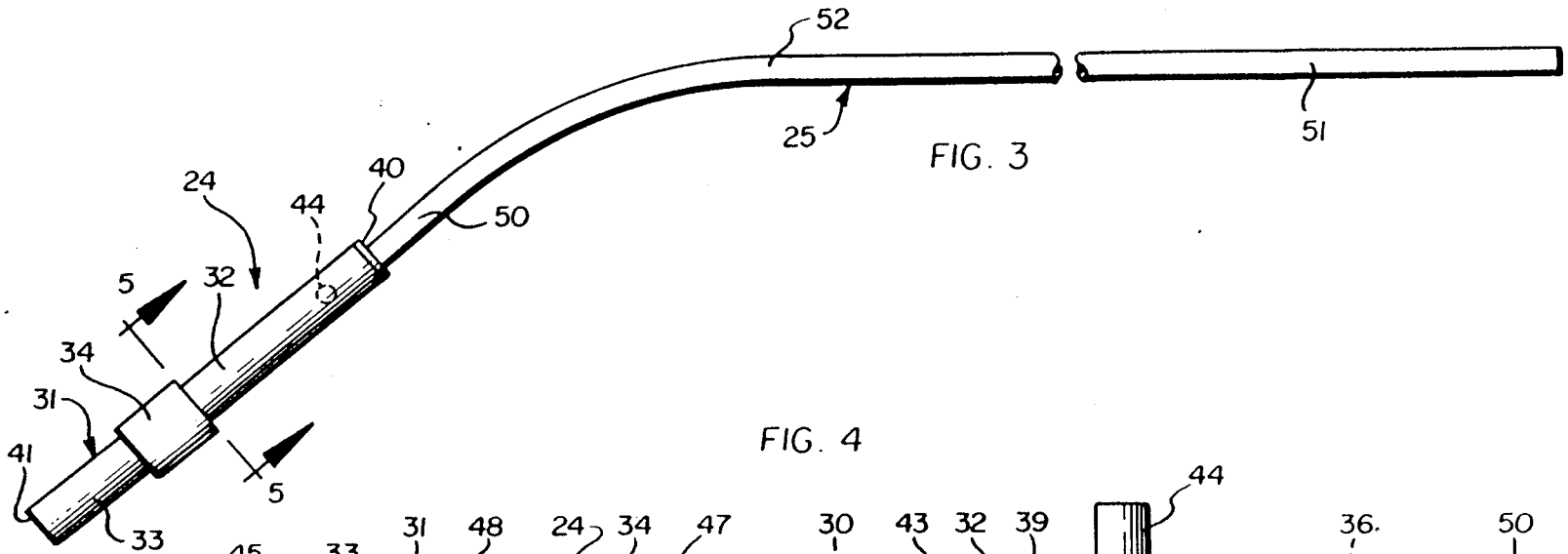
FIG. 3 is a side elevational view of an embodiment of a nozzle and transporting conduit for use in accordance with an embodiment of the present invention.

As noted above, nozzle 24 communicates with a conduit 25 for conveying a mixture of solid particles and a carrier gas to the nozzle. Conduit 25 has a downstream portion 50 communicating with inlet end 36 of inner tubular member 30. Downstream conduit portion 50 extends in a direction having a downward component, at the same angle as nozzle 24 (FIGS. 1 and 3). Inner tubular member 30 of nozzle 24 can be joined to downstream conduit portion 50 at the former's inlet end 36, or inner tubular member 30 can be an integral extension of conduit portion 50.

Conduit 25 also has a horizontally disposed portion 51 located upstream of downstream conduit portion 50. Directly connecting horizontally disposed conduit portion 51 and downstream conduit portion 50 is a convexly curved conduit portion 52. By connecting conduit portions 50 and 51 in the manner described in the previous sentence, one reduces the likelihood of flow restrictions due to the change in direction of flow at the junction of conduit portions 50 and 51. Such flow restrictions would be more likely to occur if conduit portions 50 and 51 were joined together at a sharp angle. Instead, as shown in FIGS. 1 and 3, the change in direction of flow is gradual and smooth.

As shown in FIG. 2, second stream 27 undergoes divergence upon exiting from outlet end 41 of nozzle 24. By the time second stream 27 reaches its confluence 28 with first stream 21, the width of the second stream is substantially greater than the width it had when it left nozzle 24. If the width of second stream 27 at confluence 28 is greater than the width of first stream 21, the solid particles at the extremities of the divergence in the second stream will miss first stream 21, resulting in excessive fuming and oxidation of those solid particles.

Figure 7:
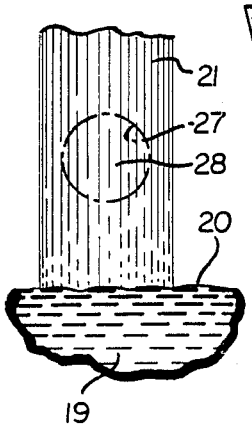
FIG. 7 is a sectional view taken along line 7—7 in FIG. 2.

The problem of excessive divergence, described in the preceding paragraph, is avoided by the present invention. Avoidance of excessive divergence is facilitated by subjecting second stream 27 to a converging step just before the second stream leaves outlet end 41 of nozzle 24. The converging step is performed in the converging internal passageway 45 at the downstream end of inner tubular member 30. In addition, the outlet end 41 of nozzle 24 is positioned sufficiently close to first stream 21 so that the width of second stream 27 at the time it reaches confluence 28 is no greater than the width of first stream 21 at confluence 28 (see FIG. 7).

Because second stream 27 is subjected to a converging step, the outlet end 41 of nozzle 24 may be positioned further away from first stream 21 than would be the case if there were no converging step. An increased distance between the nozzle's outlet end and first stream 21 is desirable because it reduces the likelihood that droplets of molten metal splashing away from confluence 28 in first stream 21 will enter nozzle 24 through its outlet end, thereby reducing the potential for blockage within either outer tubular member downstream portion 31 or inner tubular member converging portion 45. In addition, the further away nozzle 24 is from first stream 21, and from bath 19, the lower the temperature to which the nozzle is subjected and the less the likelihood that problems, which arise from exposure to high temperatures, will occur. The positioning of nozzle 24 relative to first stream 21 can be controlled by adjusting the length of transporting conduit 25 downstream of collar 23 (FIG. 1). Other convenient structure for positioning nozzle 24 may be utilized.

Converging portion 45 on inner tubular member 30 and the structure for positioning nozzle 24 comprise structure for assuring that second stream 27 has a desired width no greater than the width of first stream 21 at confluence 28.

Confluence 28 is preferably between one-third and one-half of the distance from top surface 20 of bath 19 to lower conduit end 14 of vertical conduit 13. Lower conduit end 14 is preferably positioned substantially below upper opening 17 of tundish 16. The distance between lower conduit end 14 and bath top surface 20 exceeds the width of second stream 27 at confluence 28.

As shown in FIGS. 1 and 2, the outlet end of nozzle 24 is positioned no higher than the conduit's lower end 14, and both lower conduit end 14 and the outlet end of nozzle 24 are exposed to the atmosphere surrounding ladle 10 and tundish 16.

As noted above, outlet end 37 of inner tubular member 45 is located slightly upstream of outlet end 41 of cooling jacket 31 (FIGS. 2 and 4). As a result, the solid particles in second stream 27 are at least partially enveloped with exhausted, nonoxidizing, cooling gas at an enveloping location adjacent outlet end 41 of nozzle 24. Although the enveloping gas disperses as second stream 27 moves toward confluence 28, there is at least initially some protection, against oxidation, for the solid particles in the second stream.

Annular passageway 43, between cooling gas inlet 44 and outlet end 41, is straight, without turns or bends, and essentially unobstructed (except for spacers 46, which is insubstantial), and therefore the cooling gas flowing through annular passageway 43 follows a straight path until the gas is exhausted at outlet end 41. There is no change in the direction of flow of the cooling gas from (a) the upstream nozzle-cooling location adjacent inlet 44 to (b) the exhaust location at outlet end 41. As a result, the velocity of the cooling gas flowing through passageway 43 is essentially maintained from (a) the nozzle-cooling location, adjacent inlet 44, to (b) the exhaust location at outlet 41.

If annular passageway 43 had bends or turns between gas inlet 44 and exhaust outlet 41, the cooling effect available from the flow of gas through passageway 43 would be reduced, compared to the cooling effect obtained when the gas flows along a straight path, as in the present invention.

The two Rellis, et al. patents, identified above, describe other features which may be employed when using a nozzle to introduce solid, particulate alloying ingredient mixed with a carrier gas. To the extent that they are consistent with the requirements of the present invention, as described above, these other features may also be employed with the present invention.

The foregoing detailed description has been given for clearness of understanding only, and no unnecessary limitations should be understood therefrom, as modifications will be obvious to those skilled in the art.

I claim:

1. In a process wherein molten metal descends in a vertical first stream from an upper container to a lower container, a method for adding solid particles of an alloying ingredient to said first stream, said method comprising the steps of:

forming, in said lower container, a bath of molten metal having a top surface;

directing said first stream into said lower container through a vertically disposed conduit having a lower end located above said top surface of the bath;

exposing that part of said first stream below said lower end of the conduit and above the top surface of the bath to the outside atmosphere surrounding said upper and lower containers;

providing a nozzle having an outlet end;

providing a second stream comprising a mixture of said solid particles and a carrier gas;

directing said second stream through said nozzle and into said exposed part of said first stream;

cooling said nozzle and the solid particles therein with a non-oxidizing gas moving in a direction parallel to the direction of movement through said nozzle of said second stream;

and exhausting said cooling gas into said outside atmosphere at a location adjacent said outlet end of the nozzle.

2. In a process as recited in claim 1 wherein said second stream undergoes divergence upon exiting from the outlet end of the nozzle, and said particle-adding method comprises:

converging said second stream just before the second stream leaves the outlet end of said nozzle and positioning said outlet end sufficiently close to said first stream so that the width of said second stream is no greater than the width of said first stream at the confluence of the two streams.

3. In a process as recited in claim 1 wherein said lower container has an upper opening and said particle-adding method comprises:

positioning the lower end of said conduit at a location no higher than said upper opening of the lower container.

4. In a process as recited in claim 3 wherein said particle-adding method comprises:

positioning said outlet end of the nozzle no higher than the lower end of said conduit;

and exposing said outlet end of the nozzle to said outside atmosphere.

5. In a process as recited in claim 3 wherein:

said second stream is directed toward a confluence with said first stream, said confluence being between one-third and one-half of the distance from the top surface of said bath to the lower end of said conduit.

6. In a process as recited in claim 5 wherein:

the lower end of said conduit is positioned substantially below said upper opening of the lower container;

and the distance between said lower conduit end and the top surface of the bath exceeds the width of said second stream at said confluence.

7. In a process as recited in claim 6 wherein said second stream undergoes divergence upon exiting from the outlet end of the nozzle, and said particle-adding method comprises:

converging said second stream just before the second stream leaves the outlet end of said nozzle and positioning said outlet end sufficiently close to said first stream so that the width of said second stream is no greater than the width of said first stream at the confluence of the two streams.

8. In a process as recited in claim 1 wherein said particle-adding method comprises:

at least partially enveloping said solid particles, from said second stream, with said exhausted, non-oxidizing, cooling gas, at an enveloping location adjacent said outlet end of the nozzle.

9. In a process as recited in claim 1 wherein said particle-adding method comprises:

maintaining the velocity of said cooling gas from (a) a nozzle-cooling location upstream of the nozzle's outlet end to (b) the location at which said cooling gas is exhausted.

10. In a process as recited in claim 9 wherein:

said cooling gas is exhausted adjacent said outlet end of the nozzle without changing the direction of flow of said cooling gas from (a) said upstream nozzle-cooling location to (b) said exhaust location.

11. Apparatus for adding solid particles of an alloying ingredient to molten metal, said apparatus comprising:

an upper container for holding molten metal;

a lower container disposed below said upper container;

a vertically disposed conduit having a lower open end and comprising means for directing a descending first stream of molten metal from said upper container into said lower container;

said lower container comprising means for forming a bath of molten metal having a top surface;

the space, below said lower end of the conduit and above the top surface of the bath, being exposed to the outside atmosphere surrounding said upper and lower containers;

said vertically disposed conduit comprising means for directing said first stream through said exposed space;

a nozzle having an inlet end and an outlet end;

means for introducing, into said nozzle inlet end, a second stream comprising a mixture of said solid particles and a carrier gas:

means, including said nozzle, for directing said second stream through said nozzle outlet end and into that part of said first stream in said exposed space;

said nozzle having a cooling jacket comprising means for cooling said nozzle and the solid particles therein with a cooling gas moving in a direction parallel to the direction of movement of said second stream through said nozzle;

and means for exhausting said cooling ga from said jacket into said outside atmosphere adjacent said outlet end of the nozzle.

12. Apparatus as recited in claim 11 wherein:

said lower conduit end is unenclosed by a surrounding shroud and is exposed to said surrounding atmosphere.

13. Apparatus as recited in claim 11 and comprising:

means for assuring that said second stream has a desired width no greater than the width of said first stream at the confluence of the two streams.

14. Apparatus as recited in claim 13 wherein said assuring means comprises:

means for converging said second stream immediately upstream of said outlet end of the nozzle;

and means for positioning said nozzle outlet end sufficiently close to said first stream to obtain said desired width at said confluence.

15. Apparatus as recited in claim 11 wherein:

said lower container has an upper opening;

said apparatus comprises means for positioning said lower end of the conduit at said upper opening or below;

and said apparatus comprises means, including said nozzle, for directing said second stream toward a confluence with said first stream, said confluence being between one-third and one-half of the distance from the top surface of the bath to the lower end of the conduit.

16. Apparatus as recited in claim 15 wherein:

the lower end of said conduit is positioned substantially below said upper opening of the lower container;

and the distance between said lower conduit end and the top surface of the bath exceeds the width of said second stream at said confluence.

17. Apparatus as recited in claim 11 wherein:

said lower container has an upper opening;

said apparatus comprises means for positioning said lower end of the conduit at said upper opening or below;

said outlet end of the nozzle is exposed to said outside atmosphere;

and said apparatus comprises means for positioning said nozzle outlet end below the lower end of the conduit.

18. Apparatus as recited in claim 11 wherein:

said nozzle comprises means for at least partially enveloping said solid particles, from the second stream, with said exhausted cooling gas, at an enveloping location adjacent said outlet end of the nozzle.

19. Apparatus as recited in claim 11 wherein:

said cooling jacket comprises means for maintaining the velocity of said cooling gas from (a) a nozzle-cooling location upstream of the nozzle's outlet end to (b) the location at which said cooling gas is exhausted.

20. Apparatus as recited in claim 19 wherein said means for maintaining said velocity comprises:

means for exhausting said cooling gas adjacent said outlet end of the nozzle without changing the direction of flow of said cooling gas from (a) said upstream nozzle-cooling location to (b) said exhaust location.

21. Apparatus as recited in claim 11 wherein said nozzle comprises:

an inner tubular member having an outer surface, an open, upstream, inlet end and an open, downstream, outlet end;

an outer tubular member surrounding said inner tubular member and at least in part defining said cooling jacket;

said outer tubular member having an inner surface, a closed, upstream end and an open, downstream, outlet end adjacent said outlet end of the inner tubular member;

an annular passageway between said outer surface of the inner tubular member and said inner surface of the outer tubular member;

and inlet means on said outer tubular member upstream of the outlet end thereof.

22. Apparatus as recited in claim 21 wherein:

said outlet end on the inner tubular member terminates upstream of the outlet end on the outer tubular member.

23. Apparatus as recited in claim 21 wherein:

said inlet means on the outer tubular member is located adjacent the upstream end thereof.

24. Apparatus as recited in claim 21 wherein:

said outer tubular member comprises an upstream portion and a downstream portion separate and discrete from said upstream portion;

means directly mounting said upstream portion of the outer tubular member on said inner tubular member;

and means detachably connecting said downstream portion of the outer tubular member to said upstream portion thereof;

there being no direct mounting of said downstream portion of the outer tubular member on said inner tubular member;

said downstream portion of the outer tubular member being separable from the rest of said nozzle when the downstream portion is detached from said upstream portion.

25. Apparatus as recited in claim 24 wherein:

said outlet end on the inner tubular member terminates upstream of the outlet end on the outer tubular member;

said outlet end on the inner tubular member is relatively inaccessible when said downstream portion of the outer tubular member is connected to the upstream portion thereof;

and said outlet end on the inner tubular member is accessible when the downstream portion of the outer tubular member is detached from the upstream portion thereof.

26. Apparatus as recited in claim 24 wherein:

said mounting means comprises spacer means extending between the outer surface of the inner tubular member and the inner surface of the outer tubular member.

27. Apparatus is recited in claim 24 wherein:

said detachable connecting means comprises a tubular coupling having an upstream end connected to said upstream portion of the outer tubular member and a downstream end threadedly connected to the downstream portion.

28. Apparatus as recited in claim 21 and comprising:

a conduit for conveying said second stream to said nozzle;

said conduit having a downstream portion communicating with the inlet end of said inner tubular member;

said downstream conduit portion extending in a direction having a downward component;

said conduit having a horizontally disposed portion upstream of said downstream conduit portion;

and a convexly curved conduit portion directly connecting said horizontally disposed conduit portion to said downstream conduit portion.

29. Apparatus as recited in claim 21 wherein:

said inner tubular member has an internal passageway which converges toward said outlet end thereof.

30. A nozzle for directing solid particles of an alloying ingredient to a stream of molten metal, said nozzle comprising:

an inner tubular member having an outer surface, an open, upstream, inlet end and an open, downstream, outlet end;

a cooling jacket surrounding said inner tubular member;

said cooling jacket comprising an outer tubular member having an inner surface spaced from said outer surface of the inner tubular member, a closed, upstream end and an open, downstream, outlet end adjacent said outlet end of the inner tubular member;

an annular passageway between said outer surface of the inner tubular member and said inner surface of the outer tubular member;

and inlet means on said outer tubular member upstream of the outlet end thereof.

31. A nozzle as recited in claim 30 wherein:

said outlet end on the inner tubular member terminates upstream of the outlet end on the outer tubular member.

32. A nozzle as recited in claim 30 wherein:

said inlet means on the outer tubular member is located adjacent the upstream end thereof.

33. A nozzle as recited in claim 30 wherein:

said outer tubular member comprises an upstream portion and a downstream portion separate and discrete from said upstream portion;

means directly mounting said upstream portion of the outer tubular member on said inner tubular member;

and means detachably connecting said downstream portion of the outer tubular member to said upstream portion thereof;

there being no direct mounting of said downstream portion of the outer tubular member on said inner tubular member;

said downstream portion of the outer tubular member being separable from the rest of said nozzle when the downstream portion is detached from said upstream portion.

34. A nozzle as recited in claim 33 wherein:

said outlet end on the inner tubular member terminates upstream of the outlet end on the outer tubular member;

said outlet end on the inner tubular member is relatively inaccessible when said downstream portion of the outer tubular member is connected to the upstream portion thereof;

and said outlet end on the inner tubular member is accessible when the downstream portion of the outer tubular member is detached from the upstream portion thereof.

35. A nozzle as recited in claim 33 wherein:

said mounting means comprises spacer means extending between the outer surface of the inner tubular member and the inner surface of the outer tubular member.

36. A nozzle is recited in claim 33 wherein:

said detachable connecting means comprises a tubular coupling having an upstream end connected to said upstream portion of the outer tubular member and a downstream end threadedly connected to the downstream portion.

37. In combination with the nozzle recited in claim 30:

a conduit for conveying said solid particles to said nozzle;

said conduit having a downstream portion communicating with the inlet end of said inner tubular member;

said downstream conduit portion extending in a direction having a downward component;

said conduit having a horizontally disposed portion upstream of said downstream conduit portion;

and a convexly curved conduit portion directly connecting said horizontally disposed conduit portion to said downstream conduit portion.

38. A nozzle as recited in claim 30 wherein:

said inner tubular member has an internal passageway which converges toward said outlet end thereof.

39. A nozzle as recited in claim 30 wherein:

said inner tubular member comprises means for conducting a stream comprising a mixture of solid particles and a carrier gas;

said outer tubular member comprises means for conducting a cooling gas;

and said outlet ends on said inner and outer tubular members comprise means cooperating for at least partially enveloping said solid particles, from said stream, with said cooling gas, at an enveloping location adjacent at least the outlet end of the inner tubular member.

40. A nozzle as recited in claim 39 wherein:

said outlet end on the inner tubular member terminates upstream of the outlet end on the outer tubular member.

41. A nozzle as recited in claim 40 wherein:

said enveloping location is also adjacent the outlet end of the outer tubular member.

* * * * *

UNITED STATES PATENT AND TRADEMARK OFFICE

CERTIFICATE OF CORRECTION

PATENT NO. : 4,863,684

DATED : September 5, 1989

INVENTOR(S) : Mark A. Hubbard

It is certified that error appears in the above-identified patent and that said Letters Patent is hereby corrected as shown below:

In the drawings, add sheet 2 containing Figs. 3-6 (copy attached). Delete the second sheet of drawing consisting of figures 1, 2 and 7.

Signed and Sealed this

Second Day of October, 1990

*Attest:*

HARRY F. MANBECK, JR.

*Attesting Officer*

*Commissioner of Patents and Trademarks*